United States Patent [19]

Ackermann et al.

[11] Patent Number: 4,491,074

[45] Date of Patent: Jan. 1, 1985

[54] FORCE EQUALIZING MECHANISM FOR THE WHEELS OF HEAVY LOAD-CARRYING RAIL VEHICLES

[75] Inventors: Wilhelm Ackermann, Essen; Karlheinz Langlitz, Mulheim; Gunter Schmitz, Duisburg, all of Fed. Rep. of Germany

[73] Assignee: Mannesmann Aktiengesellschaft, Dusseldorf, Fed. Rep. of Germany

[21] Appl. No.: 342,419

[22] Filed: Jan. 25, 1982

[30] Foreign Application Priority Data

Feb. 3, 1981 [DE] Fed. Rep. of Germany ..... 3103538

[51] Int. Cl.[3] ..... B61F 5/00

[52] U.S. Cl. ..... 105/164; 105/218 A; 105/157 R; 105/180; 105/168; 266/165; 266/143

[58] Field of Search ..... 105/164, 177, 157 R, 105/215 R, 215 C, 218 A, 218 R, 180, 166; 280/6 R, 6 H; 180/41, 39; 266/165, 143

[56] References Cited

U.S. PATENT DOCUMENTS

| | | | |
|---|---|---|---|
| 2,623,653 | 12/1952 | Framhein | 180/41 |
| 2,685,777 | 8/1954 | Plas | 180/41 |
| 3,269,744 | 8/1966 | Dobson | 105/177 |
| 3,531,005 | 9/1970 | McCready et al. | 105/177 |
| 3,844,429 | 10/1974 | Bode, Jr. et al. | 105/164 X |

FOREIGN PATENT DOCUMENTS

| | | | |
|---|---|---|---|
| M 11125 | 11/1955 | Fed. Rep. of Germany | 105/218 R |
| 1281477 | 10/1968 | Fed. Rep. of Germany | 105/218 A |
| 1906079 | 10/1969 | Fed. Rep. of Germany | 280/6 R |

*Primary Examiner*—Randolph Reese
*Assistant Examiner*—Glenn B. Foster
*Attorney, Agent, or Firm*—Mandeville and Schweitzer

[57] ABSTRACT

A vehicle for transporting heavy loads on parallel tracks is disclosed. Two of the wheels of the vehicle are fixedly mounted to the vehicle frame, while the remaining wheels are mounted so that they can vertically adjust to deviations in the height of the rail track. In this manner, heavy loads can be transported on the rail tracks without any particular wheel becoming overloaded.

In the preferred embodiment, the adjustable wheels are supported by bell crank levers which are themselves connected to one another by a parallelogram linkage arrangement.

6 Claims, 12 Drawing Figures

FORCE EQUALIZING MECHANISM FOR THE WHEELS OF HEAVY LOAD-CARRYING RAIL VEHICLES

BACKGROUND OF THE INVENTION AND DESCRIPTION OF THE PRIOR ART

The present invention is directed to a rail vehicle for transporting heavy leads, particularly for carrying metallurgical vessels. The heavy loads are supported on a vehicle frame and the vehicle frame, itself, is supported on rails by either two pairs of wheels or on a plurality of wheel groupings.

A rail vehicle of this type serves to transport heavy loads on rails. Since the weight forces are so very great, the travel speed is, in contrast to that of other rail vehicles, of secondary significance. The focus of the present invention is, therefore, on rail vehicles capable of use in foundry operations, i.e., those which are used to transport metallurgical converters and steelmaking furnaces, including so-called vessel changing vehicles and casting ladles.

Experience has shown that rail vehicles are sometimes, in order to avoid high cost, constructed without suspension-type spring action. So constructed, the vehicles, if operated on uneven rail tracks, exhibit great wear and tear on both the rails and the wheel support structure.

The rail tracks in the foundries, because of the changed technology in steel production and steel refining, have in the last few years been considerably extended in length. On such extended rail tracks, more and more inaccuracies between the rail levels will inevitably occur. Weighted or loaded rail vehicles have, per se, a certain degree of elasticity of their own which, if travelling on uneven rails, often results in direct contact between the wheels and the rails. Nevertheless, the maintenance of the rail tracks has proved to be relatively expensive and difficult for heavy load traffic.

In foundries, for example, deviations between tracks from a standard level are at present 30 to 40 mm. With loads of 1200 t and more, a share of approximately 300 t acts upon each of the vehicles' four wheels (assuming an equal load distribution).

While the elastic carriage frames of the rail vehicles change their shape up to a few millimeters, this will not, however, occur to the extent of the 30 to 40 mm track level deviations. Consequently, because of the difference in track levels and the inability of the vehicle to fully accommodate the deviations, an equal load distribution over the four wheels or wheel groups will not precisely occur. On the other hand, it is not reasonable to construct the rail vehicle so that it is more pliant or elastic in order to effect an even greater deformation when loaded. Furthermore, track level deviations of the rail tracks must be taken into account when the rails slope in the counter-direction from the intended direction of travel when the vehicle is fully loaded.

SUMMARY OF THE PRESENT INVENTION

The present invention is, therefore, directed to making a rail vehicle adapt to the frequently encountered track level deviations. An object sought to be accomplished by the present invention is the design and construction of a rail vehicle which, upon travelling on rail tracks exhibiting track level unevenness, a shifting of the weighted load onto any particular wheel or wheel groupings will not result in the structure of the vehicle exceeding the bending stress limit prior to deformation or the torsional stress limit.

The object of the present invention is achieved by mounting at least two wheels or wheel groupings, arranged either opposite each other across the rail track or both wheels on the same rail track, with their wheel axes of rotation being non-adjustable in height. The remaining two wheels or wheel groupings are mounted, with their wheel axes of rotation being at least adjustable in height with respect to the vehicle frame. The adjustable wheels or wheel groupings are connected to the vehicle frame by pivotable joints which, in the preferred embodiment, are connected to one another by a bar in the form of a parallel linkage mechanism. In this manner, the force of the load acts within one base area which is defined by the stationary mountings of the stationary set of wheels and the joint locations of the adjustable pair of wheels, i.e., at the corner points of the vehicle base area. With the ever-present inaccuracies of the rails, the present invention prevents individual wheels or wheel groupings from being partially relieved of the load and other wheels or wheel groupings from being partially overloaded in excess of permissible limits. The invention, then effects, to a great extent, relatively equal wheel loading. Consequently, the rail vehicle, itself, is easier to design with respect to weight. The entire support structure (rails and foundations) is also easier to design with respect to weight.

The vertical adjustability of a pair of the wheels helps to overcome, without serious difficulty, the track level deviations of 30 to 40 mm and even more. The invention, furthermore, makes it possible to obviate large springs or suspension mechanisms, the cost for which is unjustifiable in view of the expected performance.

In another embodiment of the invention, two or more of the adjustable joints of the wheels are interconnected in pairs, by force member, i.e., tension or compression transmitting members acting at the axes of rotation of the wheels or at the pivot axes if wheel groupings are used. The track level deviation occurring at one of the wheel joints is consequently transmitted to the connected wheel joint and the respective wheels or wheel groupings, which effect will also contribute to maintaining relative equal wheel loading thereby preventing individual wheel overloading.

The adjustable joints are, furthermore, designed in the form of bell cranks, with the wheel axis of rotation or, if wheel groupings are used, the swivel axis of the wheel groupings being connected to one end of the lever arm of the bell crank with the force member, i.e., the tension or compression transmitting member connected to its other lever arm. This arrangement may be applied to the wheels or wheel groupings travelling on the same rail as well as to wheels or wheel groupings located opposite each other across the rail tracks.

An advantageous embodiment of the force member in this regard is for the force member to comprise a pair of hydraulic piston and cylinder mechanisms with the pistons indirectly connected to the wheel axes of rotation and the cylinders for the pistons fastened to the vehicle frame.

This embodiment of the invention is based on the use of hydraulic power for transmitting forces. In this embodiment, the force member is a hydraulic piston-cylinder drive attached to the wheel axis of rotation and the piston-cylinder drives are hydraulically interconnected to one another.

In its simplest embodiment, however, the force member, i.e., the tension and compression transmitting member consists of a mechanical connecting rod.

An equally inexpensive solution in this respect is the use of a simple cable as the force member.

The present invention may also be carried out independently of the gauge of the rail track. It is, therefore, proposed to arrange the supporting base on the vehicle frame outside the gauge of the track.

The weight of the vehicle may also be decreased by exploiting all the other advantages of the invention, in designing the frame of the vehicle with a triangularly-shaped base area.

Exemplary embodiments are represented in the drawings and are further detailed below.

DETAILED DESCRIPTION OF THE DRAWINGS

Figure 1:
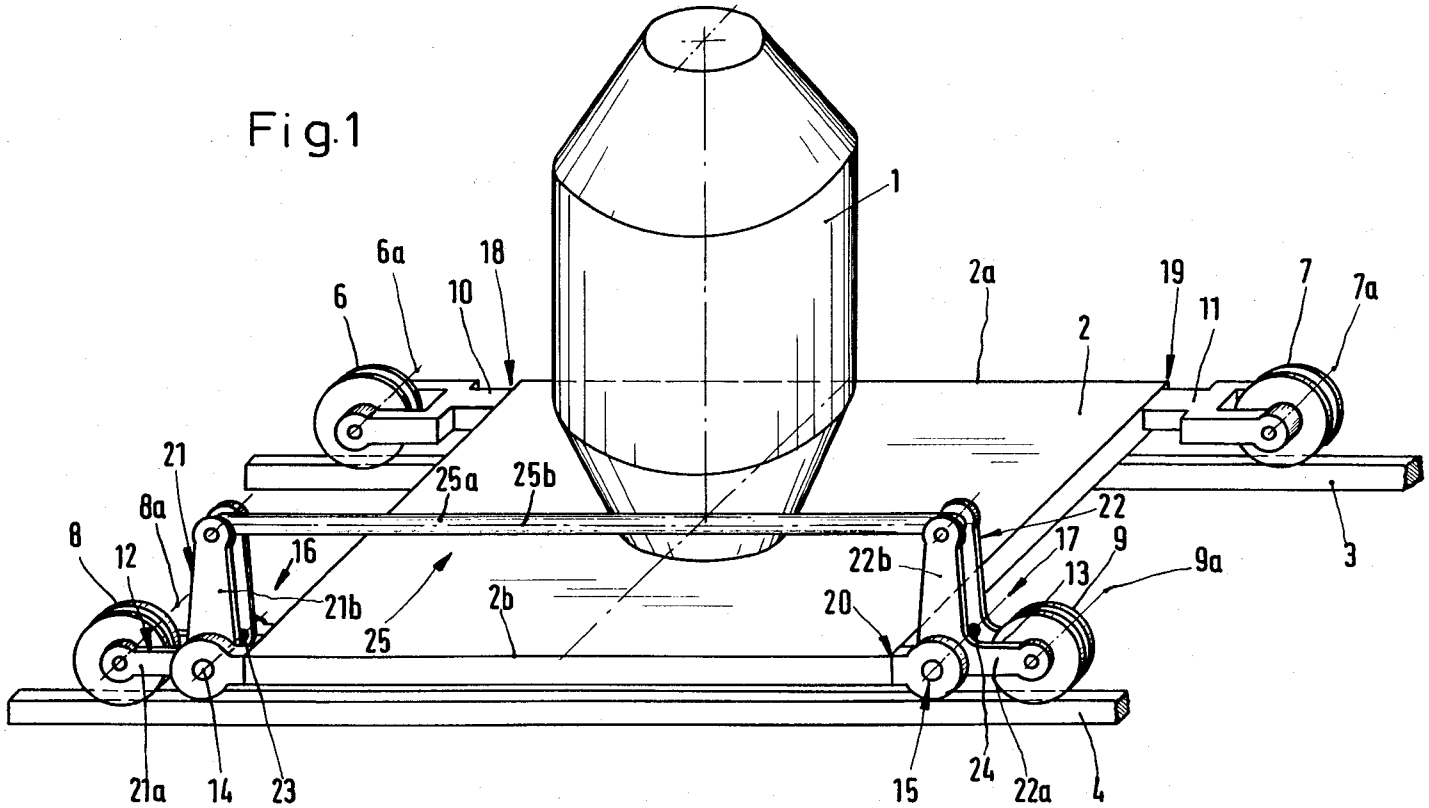
FIG. 1 is a perspective view of the rail vehicle constructed according to the invention.

The rail vehicle, according to the invention, is suitable for carrying and transporting a heavy load 1 which may, for example, consist of a steelmaking converter, furnace vessel, etc. of 1200 t or more in weight. The heavy load 1 is carried by the vehicle frame 2 and is moved on the substantially parallel rails 3 and 4.

This type of track constructed from individual rails 3 and 4, is laid in foundries between the converter stand and a clearance stand and/or newly-lined stand on the foundry floor, so that the converter load can be transported about the steel mill, as desired. The wheels 6 and 7, travel on rail 3, while the wheels 8 and 9 travel on the rail 4. The wheels 6 and 8 are opposite one another, while the wheels 7 and 9 are also opposite each other. The individual wheels 6, 7, 8 and 9 consist, in each case, of wheel groupings of two or more wheels, such that the load is distributed over a great number of individual wheels. Thus, the load is spread over the individual wheels in such a manner that the permissible load between a single wheel and rail will not be exceeded.

In the exemplary embodiment illustrated in FIG. 1, the wheel axes 6*a* and 7*a* are firmly fastened, i.e., are relatively rigidly attached to the vehicle frame 2 by means of the wheel forks 10 and 11 themselves secured to frame 2.

Consequently, the platform side 2*a* lies relatively rigid on the rail 3. Only the sag of the vehicle frame 2 due to loading, which is possible depending on the constructive design, permits an adaptation to level differences of the track 3. More extensive sagging of the vehicle frame 2 is undesirable is permanent deformations are to be avoided.

The wheel forks 12 and 13 which support the wheel axes 8*a* and 9*a* are movably fastened to the vehicle frame 2 by the pivot points 14 and 15. Consequently, the platform side 2*b* behaves differently from the behavior exhibited by platform side 2*a*. The wheels 8 and 9, then, form pivotable joint locations 16 and 17, while the wheel forks 10 and 11 represent only simple stationary mounting locations 18 and 19 which could, for example, be made by a welding construction.

The hevy load 1 is, accordingly, placed on the four-cornered base or load support area 20 with the joint locations 16 and 17 and the mounting locations 18 and 19 defining the corner points of the base area 20.

At the joint locations 16 and 17, the wheel forks 12 and 13 are designed as bell cranks 21 and 22, pivotally supported on pivot points 14 and 15 by means of pivot pins 23 and 24. The bell crank levers 21 and 22 are hinged about respective pivot pins 23 and 24 with one of their lever arms 21*a* and 22*a* extending parallel to the track and with the other lever arms 21*b* and 22*b* extending perpendicularly to the track. The lever arms 21*b* and 22*b* are connected together by way of the force member or tension or compression transmitting member 25, said member being constructed, in the exemplary embodiment in FIG. 1, of a simple mechanical connecting rod 25*a* and, in other cases, may be constructed as a tension member, i.e., a tension cable 25*b*.

Figure 4:
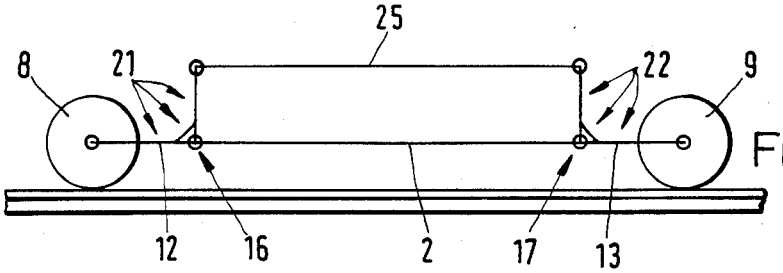
FIG. 4 is a schematic side elevational view of the rail vehicle, according to FIG. 1.
Figure 5:
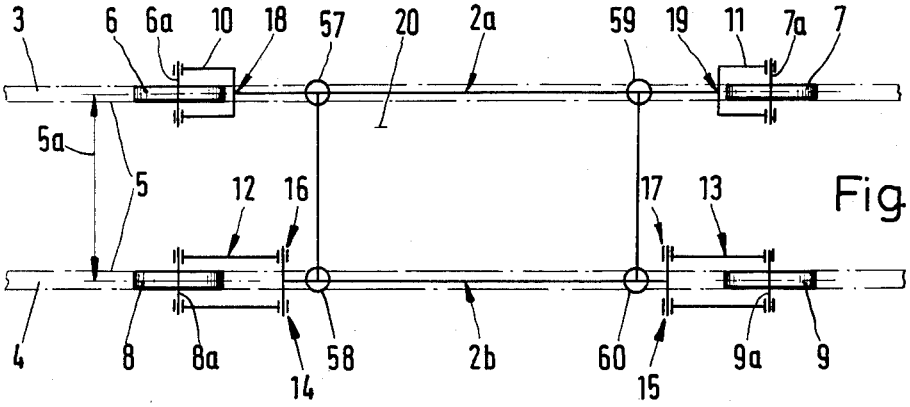
FIG. 5 is a schematic top plan view of FIG. 4.

FIGS. 4 and 5 show the exemplary embodiment shown in FIG. 1; FIGS. 4 and 5, however, are schematic side and top plan views, respectively.

Figure 6:
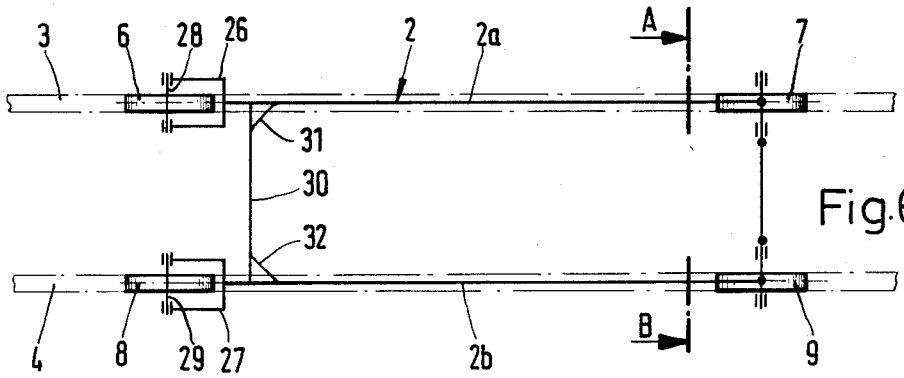
FIG. 6 is a schematic top plan view of another exemplary embodiment of the rail vehicle according to the invention.

The exemplary embodiment shown schematically in FIG. 6 shows a vehicle frame 2, supported on wheels or wheel groupings 6 and 8, which are supported by the wheel forks 26 and 27. The wheel axes 28 and 29 are immovably mounted in the wheel forks 26 and 27 at the vehicle frame 2. The vehicle frame 2 is rigidly maintained by means of a cross bar 30 having brace-type reenforcements 31 and 32 extending across the rails 3 and 4.

In contrast to wheels or wheel groupings 6 and 8, wheels or wheel groupings 7 and 9 are movably arranged on the vehicle frame 2. To that end, the structure has joint locations 33 and 34 (see FIG. 7).

Figure 7:
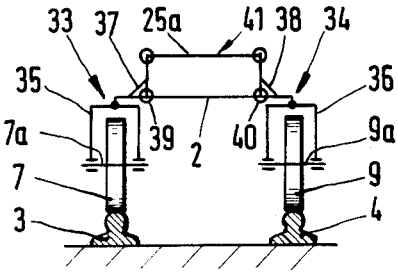
FIG. 7 is a schematic cross sectional view, taken along lines A—B of FIG. 6.

With respect to the exemplary embodiment shown in FIG. 6 and in FIG. 7, the wheel axes rest in the wheel forks 35 and 36. Bell cranks 37 and 38 are pivotally arranged in the joints 39 and 40 (in the plane of the drawing at the vehicle frame 2) and interconnected with a force member or tension and compression transmitting member 41 which, in turn, is constructed as a simple connecting rod 25*a*.

Figure 8:
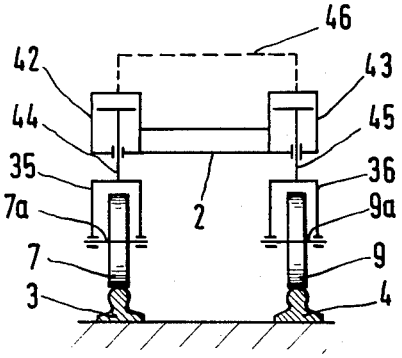
FIG. 8 is a schematic cross sectional view, taken along lines A—B of FIG. 6, yet based on an alternative embodiment of the right half of the rail vehicle.

With respect to the embodiment shown in FIGS. 6 and 8, hydraulic cylinders 42 and 43, having pistons 44 and 45 connected to the wheel forks 35 and 36 with the cylinders 42 and 43 connected to the vehicle frame 2, are provided. The cylinders 42 and 43 are in fluid communication with one another by the hydraulic equalizin g pipe 46 extending therebetween.

Figure 9:
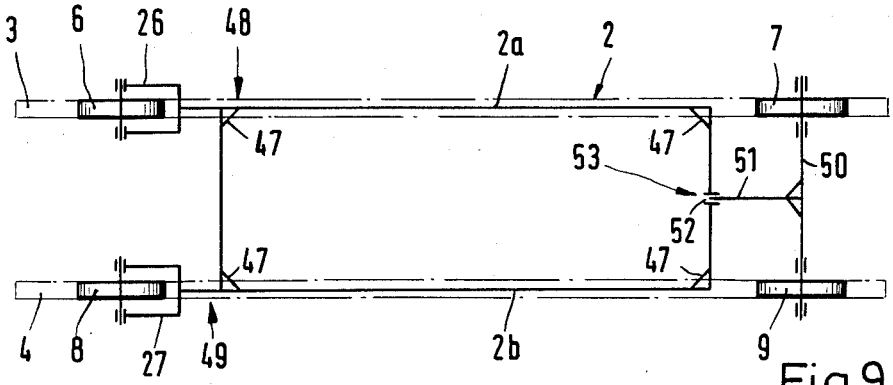
FIG. 9 is a schematic top view of a further exemplary embodiment of the rail vehicle according to the invention.

Regarding the exemplary embodiment shown schematically in FIG. 9, the vehicle frame 2 has vehicle sides 2*a* and 2*b* combined to form a rigid frame with brace-type reenforcements 47. A "rigid frame", in connection with the present invention, signifies, in principle, a vehicle frame 2 having a maximum permissible limit of sag and the ability to withstand limited torsion.

Furthermore, in this latter embodiment, the individual wheels or, if applicable, wheel groupings 6 and 8 are made substantially immovable at mounting locations 48 and 49 by means of the wheel forks 26 and 27. In contrast, the wheels or, if applicable, wheel groupings 7 and 9 are rotatably mounted on a common wheel axis 50. A journal 51 is immovably fastened to the wheel axis 50. The journal 51 is arranged in a pivot bearing 52 secured to the vehicle frame 2, which represents a joint location 53.

Figure 11:
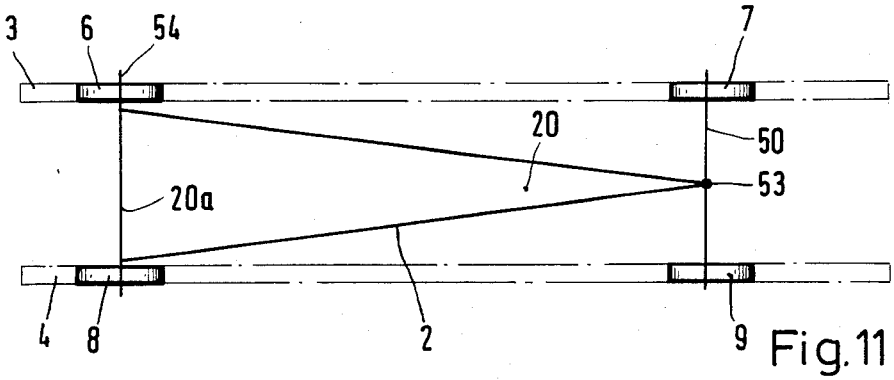
FIG. 11 is yet another schematic top plan view of an alternate embodiment of the rail vehicle.

Viewed statically, the vehicle frame 2 in FIG. 9 forms a triangular-shaped base or load support 20 which is defined by the mounting locations 48 and 49 and the joint location 53 (as shown in FIG. 11). To this end, the triangular-shaped vehicle frame 2 may, by modifying the exemplary embodiment in FIG. 9, be movably arranged, with the point of the triangle in the joint location 53, directly at the wheel axis 50, being a movable bearing having at least one degree of motion freedom in the perpendicular plane (vertical to the plane in the drawing). The vehicle frame 2 is connected directly (see FIG. 11) with the base side 20*a* of the triangular shaped base, to a common wheel axis 54 passing through both wheels 6 and 8. This solution is particularly suitable and intended for less heavy loads such as, for example, 50 t of heavy steel manufacturing converter vessels.

Figure 10:
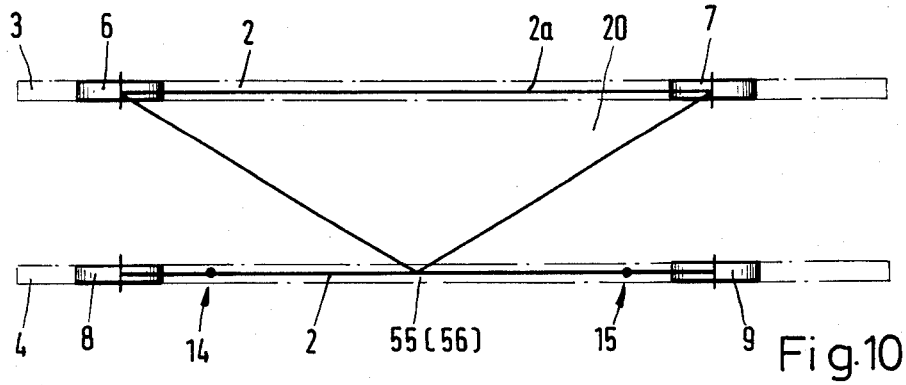
FIG. 10 is a schematic top plan view of an alternate embodiment of the rail vehicle.

Another triangular-shaped base or load support area 20 is created, in the further exemplary embodiment shown in FIG. 10, in such a form that the vehicle frame 2 is immovably arranged on the vehicle side 2*a*, shown in FIGS. 1, 4 and 5 and previously described, and the wheels or, if applicable, wheel groupings 8 and 9 are mounted on the vehicle frame 2 on the opposite rail 4 by means of joints 14 and 15.

It is also possible to have the wheels or, if applicable, the wheel groupings 8 and 9 move together on the rail 4 at the point 55 of the triangle, said point then forming a single joint location 56. In this design, too, the objective effects, according to the invention, occur.

In most cases, the heavy load 1 does not rest directly on the vehicle frame 2 but, rather, on a platform, not illustrated, with a capacity for adjusting to smaller platform sizes within the limits of the vehicle frame 2. Hydraulic support elements 57, 58, 59 and 60 (FIG. 5) are provided for this platform, said elements may also be arranged, other than illustrated, outside the track width 5*a* on a broadened vehicle frame 2.

Figure 2:
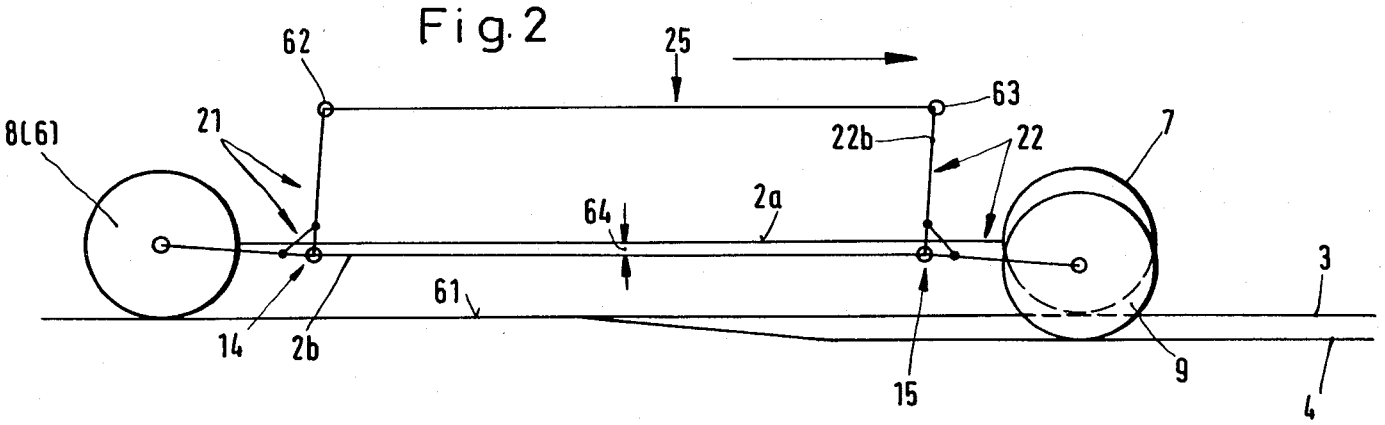
FIG. 2 is a schematic side elevational view, projected onto the drawing plane, with a rail level deviation occurring in the rail of the foreground.
Figure 3:
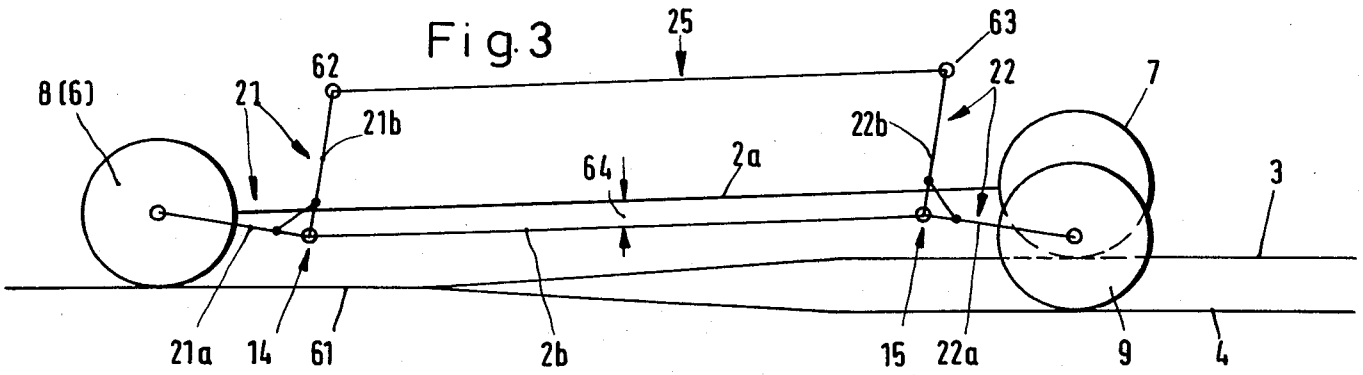
FIG. 3 is a schematic side elevational view, as in FIG. 2, with the rail vehicle in a sloping position, i.e., with the rear rail sloping higher to the right and the level of the front rail sloping down to the right.
Figure 3A:
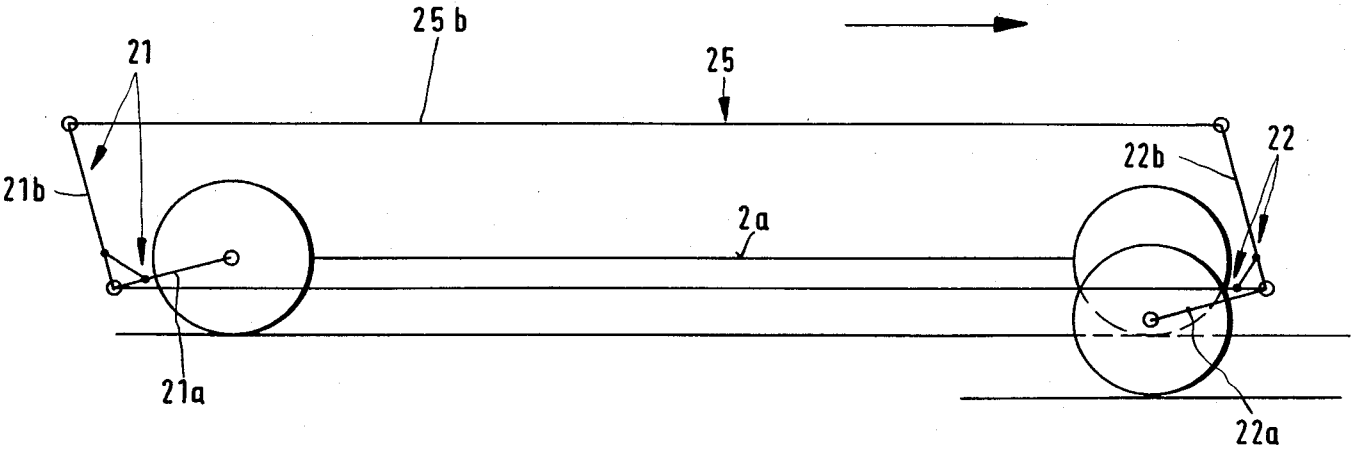
FIG. 3*a* is a side elevational view corresponding to FIG. 2, showing an alternative exemplary embodiment of the invention.

The effects sought to be accomplished by the present invention are schematically shown with the help of FIGS. 2, 3 and 3*a*, based on the exemplary embodiment shown in FIGS. 1, 4 and 5.

The sought-to-be-accomplished effects are, as explained, in principle, equal forces acting on the wheels or, if applicable, wheel groupings as they travel on the rails 3 and 4.

In case the rail 4, as illustrated (see FIG. 2), deviates from the standard level 61 (in practice, this deviation may be 30 mm and more), the vehicle side 2*a* is unaffected, i.e., the wheels or, if applicable, wheel groupings 6 and 7 remain and travel at the standard level 61. In contrast, the difference in height of the track 4 to the standard level 61 in the travelling direction of the arrow has the following consequences: The wheel or, if applicable, wheel grouping 9 descends on the downward sloping rail 4; the bell crank 22 rotates around the joint 15 at the vehicle frame 2 on the vehicle side 2*b*; the lever arm 22*b* correspondingly rotates and pulls with it, force transmitting member 25, causing the bell crank 21 to lower the joint 14 to the same extent that the wheel or, if applicable, the wheel grouping 9 has been lowered at the joint 15. In consequence, the vehicle side 2*b* adjusts lower than the vehicle side 2*a* so that the entire vehicle frame 2 slopes slightly. However, the vehicle frame 2 need not twist beyond the permissible torsional limit and the wheel or, if applicable, wheel grouping 9 is not fully relieved of the load either. Consequently, the wheel pressures on the wheels 8 and 9 remain equally great amongst themselves and with respect to the wheels 6 and 7 of the side 2*a*. In case of a load totaling 1200 t on the four wheels 6 through 9, each wheel or, if applicable, wheel grouping is allotted a weight of 300 t.

FIG. 3 represents the following situation: The rail vehicle again travels in the direction indicated by the arrow. The two rear wheels or, if applicable, wheel groupings 6 and 8 are at the standard level 61. The wheel or, if applicable wheel grouping 7 riding on rail 3 is lifted up by the rail 3 deviation above the standard level 61, and the wheel or, if applicable, the wheel grouping 9 riding on rail 4 is again lowered by the downward deviation of rail 4 from standard level 61. As may be seen fron the design of the embodiment in FIGS. 1, 4 and 5, the vehicle side 2*a*, as the "rigid" vehicle side, in the area of the wheel or, if applicable, of the wheel grouping 7, is raised, thereby schematically represented by the vehicle side 2*a* (in FIG. 3) as slightly ascending to the right.

In contrast, the wheel or, if applicable, the wheel grouping 9 adjusts the bell crank 22 downwardly, as may be seen from the deviations of the rail 4 from the standard level 61, which also causes the joint 15 to be slightly displaced downwardly. The same displacement of the joint 14 occurs through the particularly noteworthy design of the construction of the joint rectangle 14, 15, 62, 63, (in the form of parallelogram linkage) so that the lever arms 21*b* and 22*b* on the one hand, and the lever arms 21*a* and 22*a* on the other, extend parallel to one another. Nevertheless, all wheels or, if applicable, wheel groupings 6 to 9 make contact with the rails 3 and 4 and each will bear relative equal wheel pressure, in which the resulting force components remain negligibly small in the tangent direction of the rails.

The deviation in height 64 (see FIGS. 2 and 3) of the vehicle sides 2*a* and 2*b* may also be kept low with the choice of a correspondingly relative short length of the lever arms 21*a*, 22*a*.

The track level deviation situation illustrated in FIG. 3*a* corresponds to the one in FIG. 2. The design of the rail vehicle deviates from the one shown in FIG. 2, insofar as the bell cranks 21 and 22, compared to the embodiment in FIGS. 1, 2, 4 and 5, are arranged, in mirror image, in reverse to each other. Based on this arrangement, the force member 25 is designed as a tension cable 25*b*. The lever arms 21*a* and 22*a* or, if applicable, 21*b* and 22*b* again extend parallel to one another.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A rail vehicle for transporting heavy loads on parallel rail tracks comprising:

(a) a vehicle frame;

(b) a load support area, supported by said vehicle frame, for supporting said heavy loads;

(c) four wheels on individual and mechanically independent axes of rotation rotatively secured to said vehicle frame for transporting said vehicle frame on said parallel rail tracks;

(d) a first pair of said wheels, adjacent to one another, having fixed mountings on said vehicle frame, in the form of wheel forks, such that said axes of rotation of said first pair of said wheels are fixed in relative vertical movement with respect to said vehicle frame;

(e) the remaining wheels also adjacent to one another being paired and rotatively mounted to said vehicle frame by linkage joints, said linkage joints being rotatively mounted to said vehicle frame such that infinitely variable vertical movement in a limited vertical range of a first of said paired wheels due to deviations in the levelness of said rail track are automatically transmitted by a force transmitting member to provide a corresponding vertical movement of said axis of rotation of said second of said paired remaining wheels;

(f) all of said wheels having a predetermined mechanical breaking point; and (g) said corresponding vertical movement ensuring substantially equal heavy load forces on all of said wheels and preventing the heavy load forces from exceeding said breaking point on any of said wheels.

2. A rail vehicle as claimed in claim 1, wherein:

(a) said force transmitting member is a mechanical connecting means in the form of a rod.

3. A rail vehicle as claimed in claim 1, wherein:

(a) said linkage joints are bell crank levers pivotally secured to said vehicle frame; and (b) said bell crank levers have a first arm extending substantially parallel to said rail tracks for pivotally mounting said remaining wheels, and a second arm extending substantially perpendicularly to said rail tracks.

4. A rail vehicle as claimed in claim 3, wherein:

(a) said second arms of said bell crank levers are connected together by a force transmitting member.

5. A rail vehicle as claimed in claim 4, wherein:

(a) said force transmitting member is a rod.

6. A rail vehicle as claimed in claim 1, wherein:

(a) said force transmitting member comprises a pair of piston and cylinder hydraulic mechanisms;

(b) one of said pistons of said hydraulic mechanisms being connected to each of said remaining wheels;

(c) said cylinders of said hydraulic mechanisms being connected to said vehicle frame; and (d) said hydraulic mechanisms being in hydraulic fluid communication with one another.

* * * * *